US007318268B2

(12) United States Patent
Ikegaya et al.

(10) Patent No.: US 7,318,268 B2
(45) Date of Patent: Jan. 15, 2008

(54) METHOD FOR MAKING FLAT ANTENNA

(75) Inventors: Morihiko Ikegaya, Tokyo (JP); Takahiro Sugiyama, Tokyo (JP); Hisashi Tate, Tokyo (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 11/606,939

(22) Filed: Dec. 1, 2006

(65) Prior Publication Data

US 2007/0074385 A1 Apr. 5, 2007

Related U.S. Application Data

(62) Division of application No. 11/151,228, filed on Jun. 14, 2005, now abandoned, which is a division of application No. 10/280,097, filed on Oct. 25, 2002, now Pat. No. 6,917,333.

(30) Foreign Application Priority Data

Nov. 9, 2001 (JP) ..... 2001-344882

(51) Int. Cl.
*H01P 11/00* (2006.01)

(52) U.S. Cl. ..... 29/600; 343/700 MS; 343/702

(58) Field of Classification Search ..... 29/600, 29/601, 602.1, 827, 829, 830–832, 836, 842, 29/846, 847; 343/700 MS, 702, 872, 767, 343/729, 830; 72/46–53
See application file for complete search history.

(56) References Cited

U.S. PATENT DOCUMENTS 4,497,012 A * 1/1985 Gottlieb et al. ..... 361/306.2
5,291,210 A * 3/1994 Nakase ..... 343/700 MS
5,600,337 A 2/1997 Cassel
5,835,063 A 11/1998 Brachat et al.
6,344,823 B1 * 2/2002 Deng ..... 343/700 MS
6,407,715 B1 6/2002 Chen
6,448,933 B1 * 9/2002 Hill et al. ..... 343/702
6,478,229 B1 11/2002 Epstein
6,600,448 B2 * 7/2003 Ikegaya et al. ..... 343/700 MS
6,789,308 B2 * 9/2004 Takaba et al. ..... 29/600
6,917,333 B2 * 7/2005 Ikegaya et al. ..... 343/700 MS
2002/0149529 A1 10/2002 Fleming et al.

(Continued)

FOREIGN PATENT DOCUMENTS

EP 0 749 176 A1 12/1996

(Continued)

*Primary Examiner*—Minh Trinh
(74) *Attorney, Agent, or Firm*—Foley & Lardner LLP

(57) ABSTRACT

A method of making a flat-plate antenna having thinner shape and excellent productivity, reducing labor for installation in an electrical apparatus or on a wall, and exhibiting desired antenna characteristics stably. The method includes forming a conductive flat-plate having a slit portion, a radiating element portion, and a ground portion formed by press punching a lead-frame. The method also includes laminating over the lead-frame with a resinous film. The method further includes forming first and second connecting holes through which a part of the lead-frame is exposed. The method also includes press punching the laminated lead-frame including the slit portion, the radiating element portion and the ground portion. The method still further includes connecting first and second conductors of a power supply line with the radiating element portion and the ground portion, respectively.

1 Claim, 4 Drawing Sheets

U.S. PATENT DOCUMENTS

| | | | |
|---|---|---|---|
| 2003/0043083 | A1 | 3/2003 | Huang |
| 2003/0112202 | A1 | 6/2003 | Vogt |

FOREIGN PATENT DOCUMENTS

| | | | |
|---|---|---|---|
| EP | 1 280 226 | A1 | 1/2003 |
| GB | 2 345 581 | A | 7/2000 |
| JP | 05-022018 | A | 1/1993 |
| JP | 5-206716 | A | 8/1993 |
| JP | 5-243837 | A | 9/1993 |
| JP | 8-97625 | A | 4/1996 |
| JP | 8-503580 | A | 4/1996 |
| JP | 8-186430 | A | 7/1996 |
| JP | 2789611 | B2 | 6/1998 |
| JP | 2000-134029 | A | 5/2000 |
| JP | 2000-174531 | A | 6/2000 |
| WO | WO 99/28991 | A1 | 6/1999 |
| WO | WO 00/52784 | A1 | 9/2000 |
| WO | WO 01/82408 | A1 | 11/2001 |

* cited by examiner

METHOD FOR MAKING FLAT ANTENNA

BACKGROUND OF THE INVENTION

The present application is a divisional of U.S. application Ser. No. 11/151,228, filed Jun. 14, 2005, now abandoned which is a divisional of application Ser. No. 10/280,097, filed Oct. 25, 2002, which is now U.S. Pat. No. 6,917,333, issued on Jul. 12, 2005, the entire contents of which are incorporated herein by reference.

FIELD OF THE INVENTION

The present invention relates to a flat-plate antenna for installation in an electrical apparatus such as a portable terminal or an electric appliance or on a wall or the like, and method for manufacturing the same, and more specifically, to flat-plate antenna and method for manufacturing the same for realizing thinner shape and excellent productivity, reducing labor for installation in an electrical apparatus or on a wall, and exhibiting desired antenna characteristics stably.

PRIOR ART

In recent years, except large-scale antennas for use in base station or satellite broadcasting, tendency to compactness of various kinds of antennas for use in a potable telephone or a mobile computer (hereinafter collectively referred to as "a portable terminal") have been progressing. Especially, accompanied with tendency to compactness of portable terminal itself, an antenna for use in a portable terminal is required to solve problems of installation space and request for satisfying characteristics contradicting to restriction of antenna volume. Moreover, in a plan of domestic wireless network which has been progressing recently, problem of an antenna size has been arisen, in accordance with installation of an antenna in a personal computer or an electric appliance (hereinafter collectively referred to as "an electric appliance") or on a wall surface within a room.

In FIG. 1(*a*) and FIG. 1(*b*), an example of a conventional small-size antenna is shown. This small-size antenna is a kind of inverted-F antenna, and is formed by connecting a chip antenna 50 on a ground portion 53 of a cupper plate by solder reflowing. The chip antenna 50 having a radiating element portion 51*a*, 51*b*, a connecting portion 51*c* and a power supply portion (not shown in the figure) each of which are formed by covering a surface of a ceramic dielectric 52 with a cupper layer by photolithography. The construction as described above leads to shorten length of a radiating element portion 51*a* of an antenna due to dielectric constant of a ceramic dielectric exceeding ten (10). Consequently, compact and lightweight antenna is realized.

However, according to a conventional small-size antenna, firstly, antenna efficiency is inferior due to large dielectric loss of a ceramic dielectric. Secondly, tendency to compactness and lightweight of a potable terminal such as a note-type personal computer or a potable telephone may be obstructed due to restriction of antenna thickness due to dependence of overall antenna thickness on a ceramic dielectric thickness. Thirdly, labor for connecting a power supply line is needed during installation work of an antenna in an electrical apparatus or on a wall. Fourthly, productivity of an antenna is inferior because process for forming a cupper layer on a radiating element potion and process for connecting a chip antenna on a cupper plate are separate. Fifthly, cost of an antenna increases due to inferior productivity of an antenna and expensiveness of a ceramic dielectric.

SUMMARY OF THE INVENTION

An object of the present invention is to provide a flat-plate antenna and method for manufacturing the same for realizing thinner shape and excellent productivity, reducing labor during installation in an electrical apparatus or on a wall, and stably exhibiting desired antenna characteristics.

In accordance with this invention, there is provided a flat-plate antenna comprising a conductive flat-plate, a slit portion formed through said conductive plat-plate with width proportional to frequency band width, a radiating element portion disposed one side of said slit portion, a ground portion disposed other side of said slit portion, and a power supply line having a first conductor connected to said radiating element and a second conductor connected to said ground portion. Since connection between a power supply cable and a conductive flat-plate is formed previously, labor for connecting a power supply line during installation work of an antenna is eliminated. If a power supply line is extended along a surface of said conductive flat-plate, thin shaped antenna could be obtained.

In accordance with further example of the present invention, there is provided a flat-plate antenna comprising a conductive flat-plate, a slit portion formed through said conductive flat-plate with width proportional to frequency band width, a radiating element portion disposed one side of said slit portion, a ground portion disposed other side of said slit portion, a power supply line having a first conductor connected to said radiating element and a second conductor connected to said ground portion, and a covering substrate covering at least said conductive flat-plate. Since a conductive flat-plate is reinforced with a covering substrate, deformation of a conductive flat-plate is prevented.

In accordance with this invention, there is provided a method for manufacturing a flat-plate antenna comprising a step of forming a conductive flat-plate having a slit portion with width proportional to frequency band width, a radiating element portion disposed one side of said slit portion, and a ground portion disposed other side of said slit portion, wherein said slit portion is formed by press punching through said conductive flat-plate, and a step of connecting a first conductor of a power supply line with a part of said radiating element portion and a second conductor with a part of said ground portion. If slits are preferably formed by press punching on plural portions along length direction of a lead-frame, a plurality of conductive flat-plates could be obtained at once from a piece of lead-frame.

In accordance with further example of this invention, there is provided a method for manufacturing a flat-plate antenna comprising a step of forming a conductive flat-plate having a slit portion with width proportional to frequency band width, a radiating element portion disposed one side of said slit portion, and a ground portion disposed other side of said slit portion, wherein said slit portion is formed by press punching through a lead-frame, a step of laminating over said lead-frame with a resinous film, a step of forming a first and second connecting hole through which a part of said lead-frame of said radiating element portion is exposed, a step of press punching said laminated lead-frame including said slit portion, said radiating element portion and said ground portion, and a step of connecting a first conductor of a power supply line with a part of said radiating element portion exposed through said first connecting hole and a second conductor of a power supply line with a part of said ground portion exposed through said second connecting hole. Since a conductive flat-plate is reinforced with resinous film, deformation of a conductive flat-plate which is formed by press punching a lead-frame including a slit portion, a radiating element portion and a ground portion is prevented.

BRIEF DESCRIPTION OF THE DRAWINGS

FIG. 1(*b*) shows a side view of a conventional small-size antenna.

FIG. 2(*b*) show a sectional view taken along line A-A of FIG. 2(*a*).

FIG. 2(*c*) show a sectional view taken along line B-B of FIG. 2(*a*).

DESCRIPTION OF THE PREFERRED EMBODIMENTS

Figure 1A:
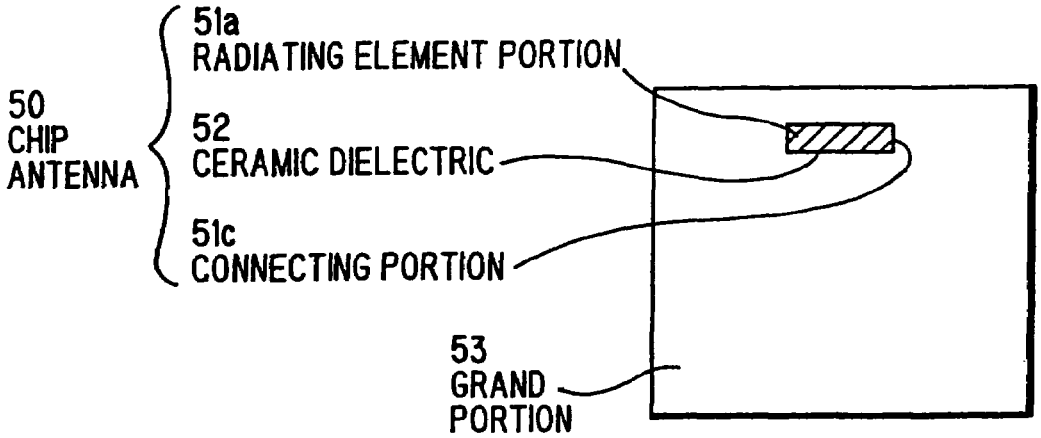
FIG. 1A PRIOR ART
FIG. 1(*a*) shows a plane view of a conventional small-size antenna.
Figure 1B:
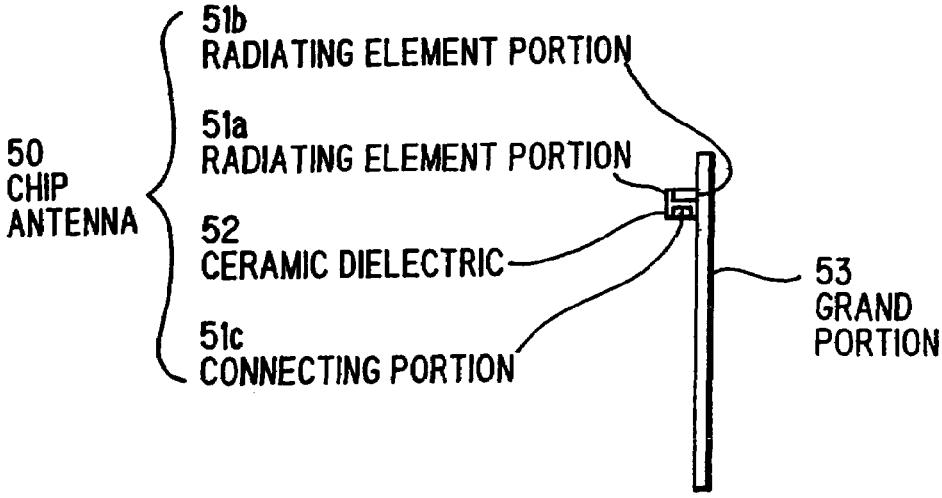
FIG. 1B PRIOR ART
Figure 2A:
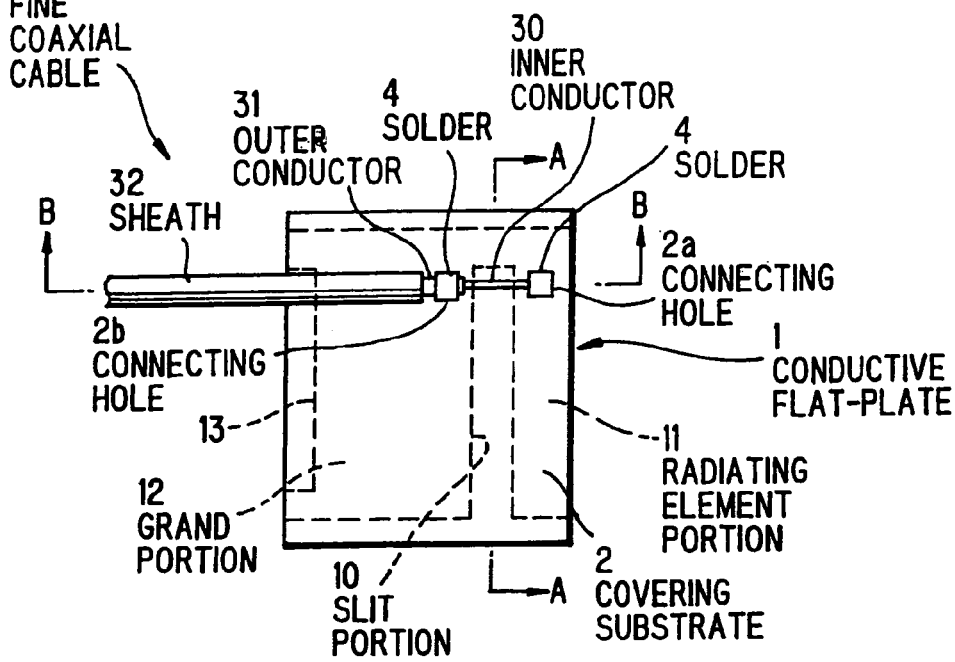
FIG. 2(*a*) shows a plane view of a flat-plate antenna according to an example of the present invention.
Figure 2B:
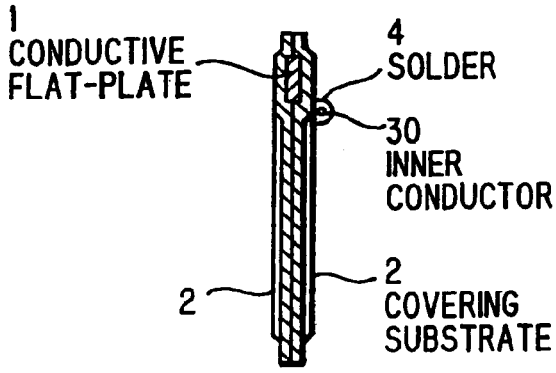
Figure 2C:
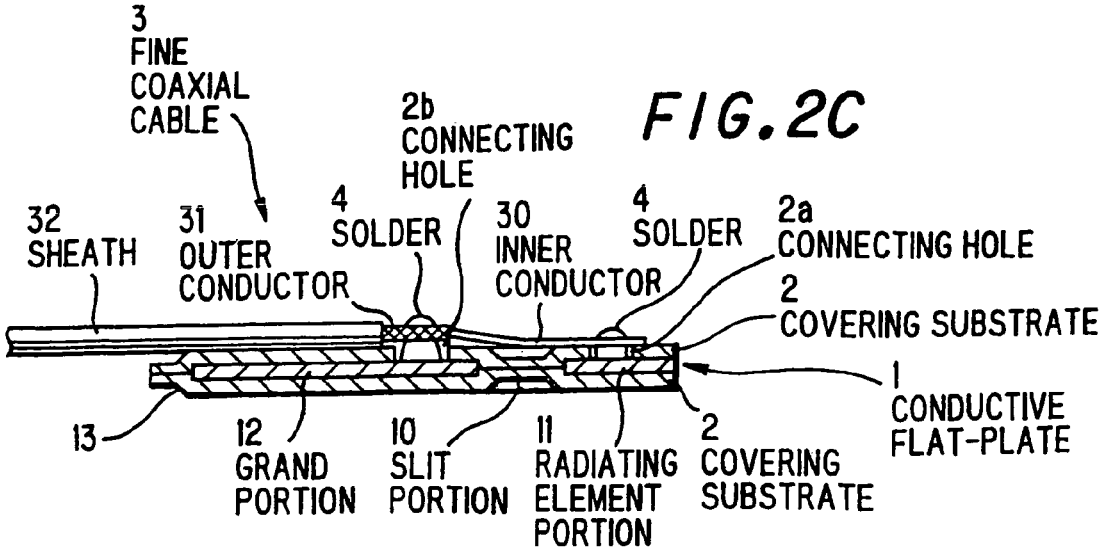

A flat-plate antenna according to an example of the present invention is shown in FIG. 2(*a*)-FIG. 2(*c*). A flat-plate antenna comprises a slit portion 10 having width proportional to frequency band width, a conductive flat-plate 1 having a L shaped radiating element portion 11 disposed on one side of said slit portion 10 and a ground portion 12 disposed on other side of said slit portion 10, a covering substrate 2 covering said conductive flat-plate 1 with a resinous film and a fine coaxial cable 3 supplying power to said conductive flat-plate 1.

A covering substrate 2 is preferably formed by laminating over a surface of conductive flat-plate 1 with a resinous film. A heat resistant film such as a polyester film is preferably used as a resinous film to reinforce a conductive flat-plate 1 and to prevent deformation of it. Moreover, melting or deformation of a conductive flat-plate 1 caused by heat of solder connecting of a fine coaxial cable 3, or heat from surrounding operating apparatus can be prevented. Especially, a polyester film keeps the conductive flat-plate 1 clean for a long term by preventing defect, breakage, dirt or etc. due to its excellent heat resistant, water resistant and wear resistant. Other heat resistant films such as a polyimide film, a polyamide film or a polyphenylene-sulphide film are applicable in the present invention.

A fine coaxial cable 3 is comprising an inner conductor 30 formed by a single wire or a stranded wire having a plurality of wires, an outer conductor 31 formed on an inner conductor 30 through insulating layer, and a sheath 32 covering an outer conductor 31. Length of a fine coaxial cable 3 depends on a kind of applying electric apparatus or wall. For example, a length of a fine coaxial cable is 400 mm for use in notebook-type personal computer. If a flat-plate antenna is installed on a display, a wiring to communication module disposed back of keyboard through hinge portion is made by use of a fine coaxial cable. Electrical connections between an inner conductor 30 of a fine coaxial cable 3 and a radiating element portion 11, and between an outer conductor 31 and a ground portion 12 are made by solder 4 at a portion where impedance matching is achieved. Electrical connection may be achieved by conductive adhesives, connectors or etc. A flat cable formed by arranging a first conductor connected to the radiating element portion 11 and a second conductor connected to the ground portion 12 on a same plane may be used as a power supply line instead of a fine coaxial cable 3. By using such a flat cable, a thinner flat-plate antenna can be obtained.

Figure 3:
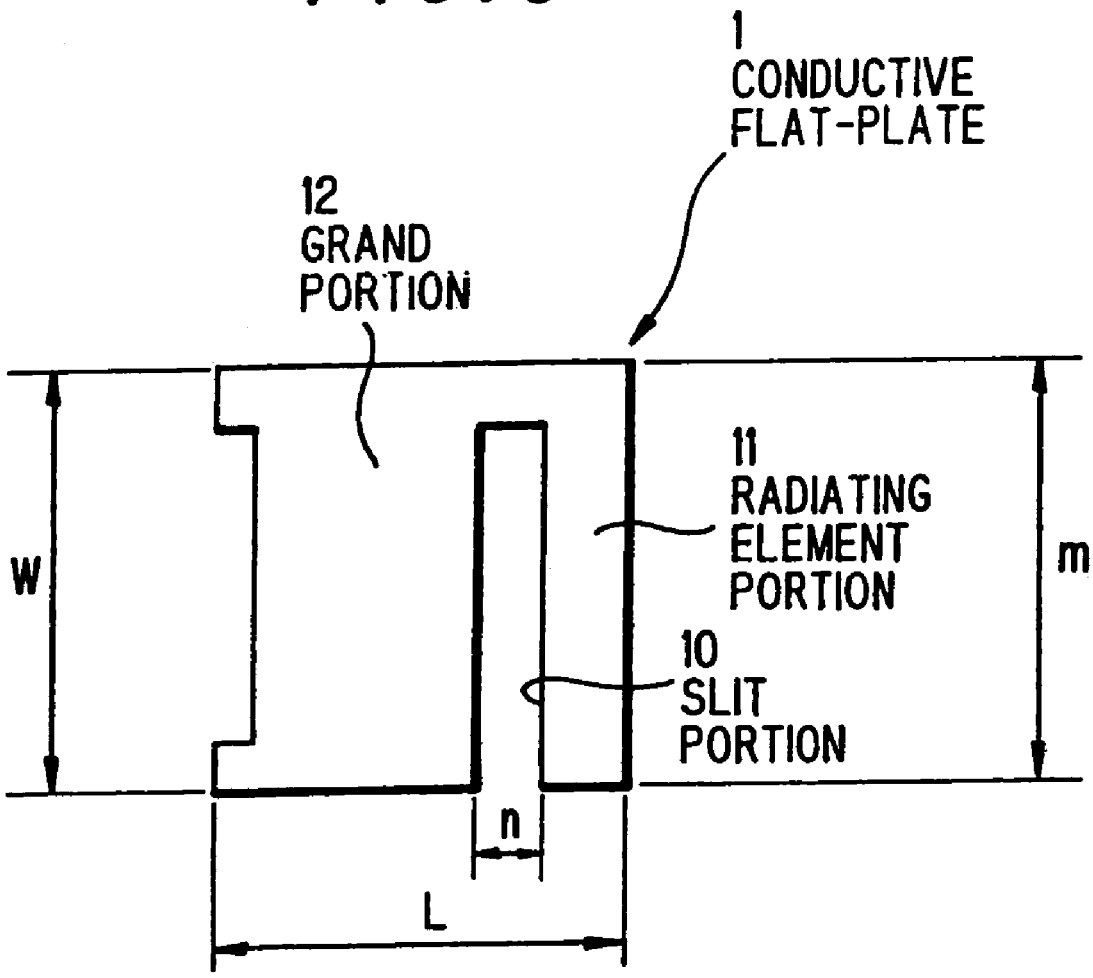
FIG. 3 shows a plane view of a conductive flat-plat according to an example of the present invention.
Figure 4A:
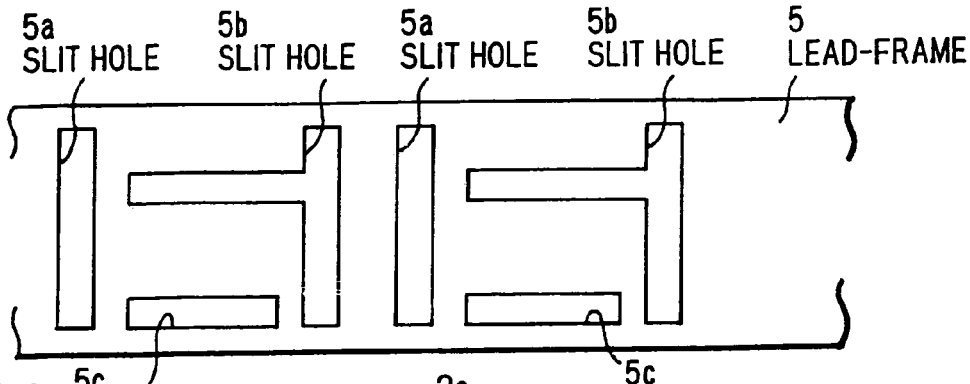
FIG. 4(*a*), FIG. 4(*b*), FIG. 4(*c*) and FIG. 4(*d*) show a manufacturing step of flat-plate antenna according to an example of the present invention.
Figure 4B:
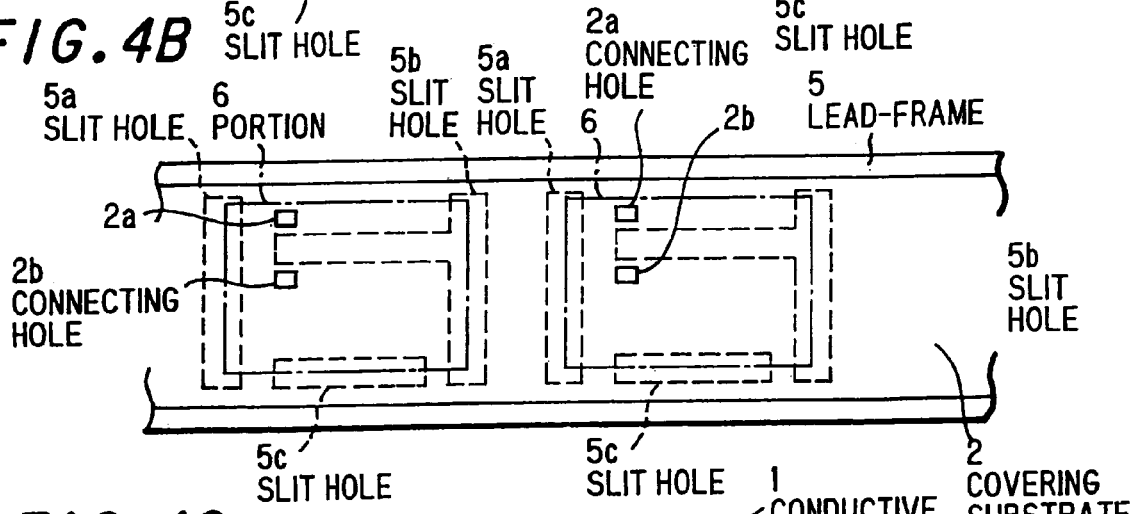
Figure 4C:
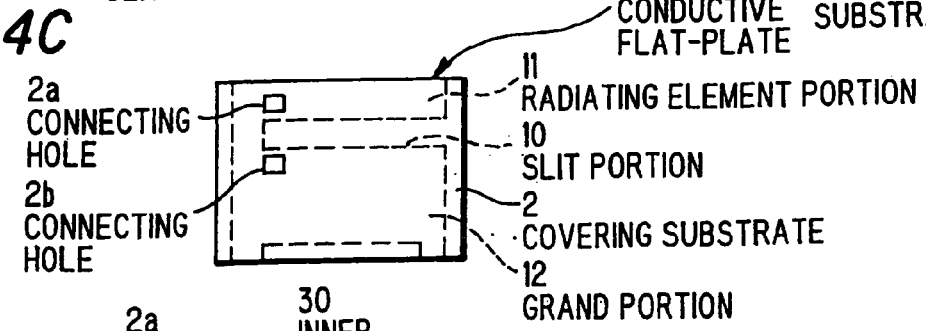
Figure 4D:
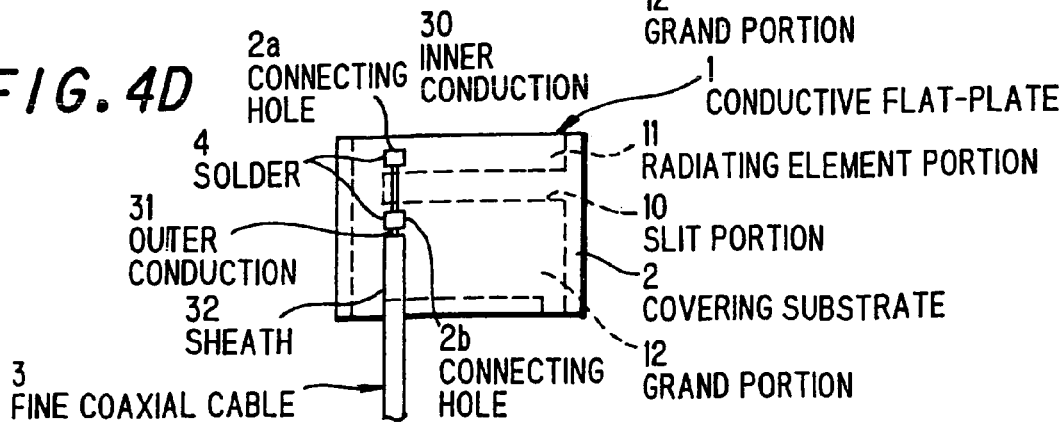

A conductive flat-plate 1 according to an example of the present invention is shown in FIG. 3. In general, length m of a radiating element portion 11 of a flat-plate antenna 1 is selected to be $\lambda$, $\lambda/2$, $\lambda/4$, $\lambda/8$ or the like, wherein $\lambda$ is a wave length of operating frequency. The shorter a length m, the more compact flat-plate antenna is obtained. However, if length m is too short, a flat-plate antenna with low sensitivity or narrow frequency band might be obtained. Considering the foregoing, length m of a radiating element portion 11 is selected to be $\lambda/4$ in this example. For example, if operating frequency is 2.4 GHz, length m of a radiating element portion 11 is about 30 mm. If a flat-plate antenna is installed in a housing of an electric appliance, operating frequency is determined by installing position, and if a flat-plate antenna is installed on a wall, operating frequency is determined by installing circumstance. Size of each portion of a conductor flat-plate 1 such as width and length of a slit portion 10 or width and length of a radiating portion 11 is determined by desired antenna characteristics. Length m of a radiating element portion 11 contributes to resonant frequency, width n of the slit portion 10 contributes to frequency band, and ratio L/W between length L of a conductor flat-plate 1 and width W of a ground portion 12 contributes to directivity.

A process for manufacturing a flat-plate antenna according to an example of the present invention is shown in FIG. 4(*a*)-FIG. 4(*d*). Slit holes 5*a*, 5*b* and 5*c* having 2 mm width are formed together by press punching on plural portions along length direction of a lead-frame 5. The lead-frame is made of phosphor bronze and having 0.2 mm thickness and 40 mm width. As shown in FIG. 4(*b*), a lead-frame 5 is exposed through connecting holes 2*a*, 2*a*. These connecting holes 2*a*, 2*b* are formed by etching a part of surface of a polyester film after laminating over both surfaces of lead-frame 5 with polyester film. A substance as shown in FIG. 4(*c*) is obtained by press punching a portion 6 as shown dotted line of FIG. 4(*b*). As shown in FIG.4(*d*), an inner conductor 30 of a fine coaxial cable 3 is connected by solder 4 to a radiating element portion 11 which is exposed through connecting hole 2*a*, and a outer conductor 31 of a fine coaxial cable 3 is connected by solder 4 to a ground portion 12 which is exposed through connecting hole 2*b*.

According to an example explained above, the following effects are performed.

(a) Since a conductive flat-plate is laminated with a heat resistant resinous film such as polyester film and a fine coaxial cable is extended along a surface of a conductive flat-plate, when a conductive flat-plate having 0.2 mm thickness, a fine coaxial cable having 0.8 mm diameter, and a resinous film having 0.1 mm thickness are used, a thin-type flat-plate antenna having 1.2 mm overall thickness can be obtained. Consequently, thin-type antenna become to be installed in a narrow space of a housing, installment in an electrical apparatus or on a wall easily established.

(b) Since deformation of a conductive flat-plate is prevented by laminating a conductive flat-plate with a resinous film, when a flat-plate antenna is installed in an electrical apparatus, desired antenna characteristic can be exhibited stably. Referring to FIG. 3, by determining length m of a radiating element portion 11 as 30 mm, resonant frequency 2.4 GHz matched with operating frequency is obtained, further, by determining width n of a slit portion 10 as 2 mm, frequency band width more than 200 MHz is obtained, further more, by determining both length L of a conductive flat-plate and width W of a ground portion as 30 mm, non-directivity is obtained.

(c) Since a fine coaxial cable is previously connected to a conductive flat-plate, labor for connecting a fine coaxial cable is eliminated during installation work of a flat-plate antenna in an electric apparatus or on a wall. Further, by using a fine coaxial cable as a power supply line, wiring of a fine coaxial cable within an electrical apparatus is fulfilled freely without obstructing to other parts arranged in said electrical apparatus.

(d) Since a plurality of conductive flat-plates are obtained at once from a piece of lead-frame, productivity and cost are improved.

As described in detail above, according to the present invention, labor for connecting a power supply line during installation work of an antenna is eliminated by connecting between a power supply cable and a conductive flat-plate previously.

Further, thin shaped antenna can be obtained by extending a power supply line along a surface of a conductive flat-plate.

Further, desired antenna characteristic can be exhibited stably, because deformation of a conductive flat-plate is prevented by reinforcement of a conductive flat-plate with resinous film.

Further, obtaining a plurality of conductive flat-plates at once from a piece of lead-frame and improving productivity of a flat-plate antenna become possible by using a lead-frame as a conductive flat-plate and by press punching on plural portions along length direction of a lead-frame.

What is claimed is:

1. A method for manufacturing flat-plate antenna comprising the steps of:

forming a conductive flat-plate having a slit portion with width proportional to frequency band width, a radiating element portion disposed one side of said slit portion, and a ground portion disposed other side of said slit portion, said slit portion is formed by press punching through a lead-frame;

laminating over said lead-frame with a resinous film;

forming a first connecting hole through which a part of said lead-frame of said radiating element portion is exposed, and forming a second connecting hole through which a part of said lead-frame of said radiating element portion is exposed;

press punching said laminated lead-frame including said slit portion, said radiating element portion and said ground portion; and connecting a first conductor of a power supply line with a part of said radiating element portion exposed through said first connecting hole, and connecting a second conductor of a power supply line with a part of said ground portion exposed through said second connecting hole.

* * * * *